US005601144A

United States Patent [19]

Keet

[11] Patent Number: 5,601,144

[45] Date of Patent: Feb. 11, 1997

[54] APPARATUS FOR FLUID RECOVERY FROM PLURALITY OF WELLS

[75] Inventor: Ben Keet, North Melbourne, Australia

[73] Assignee: Geo & Hydro International Pty. Ltd., Melbourne, Australia

[21] Appl. No.: 436,428

[22] PCT Filed: Nov. 23, 1993

[86] PCT No.: PCT/AU93/00595

§ 371 Date: Jul. 24, 1995

§ 102(e) Date: Jul. 24, 1995

[87] PCT Pub. No.: WO94/12762

PCT Pub. Date: Jun. 9, 1994

[30] Foreign Application Priority Data

Nov. 24, 1992 [AU] Australia ..... PL 5992

[51] Int. Cl.[6] ..... E21B 43/00

[52] U.S. Cl. ..... 166/263; 166/370; 166/53

[58] Field of Search ..... 166/54.1, 263, 166/370, 369, 372, 53, 72

[56] References Cited

U.S. PATENT DOCUMENTS

| | | | |
|---|---|---|---|
| 4,449,582 | 5/1984 | Peterson et al. | 166/64 |
| 4,895,085 | 1/1990 | Chips | 110/346 |
| 5,017,289 | 5/1991 | Ely et al. | 166/246 X |
| 5,246,309 | 9/1993 | Hobby | 405/128 |
| 5,249,888 | 10/1993 | Braithwaite et al. | 405/128 |
| 5,287,927 | 2/1994 | Pass et al. | 166/267 |
| 5,387,057 | 2/1995 | DeLoach | 166/370 X |

OTHER PUBLICATIONS

I. Muravyov et al, pp. 296–299 and 334–335, "Development and Exploitation of Oil and Gas Fields", Peace Publishers, Moscow (Translation from the Russian).

*Primary Examiner*—Roger J. Schoeppel
*Attorney, Agent, or Firm*—Larson & Taylor

[57] ABSTRACT

A multi-point recovery system for recovering fluid from a plurality of wells, including a pumping apparatus which connects a suction pump sequentially to different wells or groups of wells. The apparatus includes a row of ports in a surface above which a carriage moves on wheels to connect the suction pump to different ports or groups of ports in turn. Hoses are inserted into each well and connect to the ports. The hoses have a high point near the well providing a gravity trap to prevent recovered fluid from running back into the well. The wells may be sealed at the top to allow pumping of soil air.

19 Claims, 4 Drawing Sheets

APPARATUS FOR FLUID RECOVERY FROM PLURALITY OF WELLS

This invention relates to the recovery of fluids from a plurality of wells, and in particular but not limited to the recovery of contaminants such as hydrocarbons from above or below the ground water.

When a subterranean reservoir of fluid lies close to the surface, it is possible to recover the fluid from a small region by sunking a shallow well and simply drawing the fluid out through the well via a tube attached to a suction pump. A typical situation in which these circumstances arise is when an area of land is contaminated by an immiscible fluid such as a hydrocarbon which is lying above the ground water or below the ground water above an impermeable layer. Where the amount of contaminant is relatively small, it is feasible to sink a number of small diameter wells each equipped with pumping equipment over the area in which the fluid needs to be recovered. However, it is not economically viable to duplicate the pumping equipment for a large number of wells, and in situations where it is possible or desirable to pump the fluid from each well over only short periods a system can be envisaged whereby a single pumping apparatus is used which distributes its pumping action amongst the wells on a time basis. It can be desirable to pump at each individual well for only short periods interposed by long periods of inactivity because the seepage of ground water and contaminants into the well is often a slow process and a short period of pumping will remove all the accumulated fluid.

In such a system, it is necessary to provide a means for switching the action of the pump amongst the wells. One solution might be to install a solenoid valve in the tube leading from each well, to connect all the tubes to a common vacuum source and to operate the solenoid valves sequentially by a timing mechanism. There are two disadvantages inherent in this solution. First, where there are a large number of wells, the cost associated with each individual solenoid valve becomes prohibitive. Second, solenoid valves can be dangerous in circumstances where the contaminant to pumped is volatile and inflammable, due to the possibility of electrical sparks.

It is therefore an object of this invention to provide an apparatus for distributing the pumping time amongst a number of wells which is economical and safe.

Therefore in accordance with a first broad aspect of the invention there is provided an apparatus for recovering fluid from a plurality of remote wells, the apparatus including a plurality of orifices arranged side by side, each orifice in fluid communication with at least one of the remote wells;

connecting means to connect a suction pump to the orifices in groups of one or more at a time;

wherein the connecting means and the orifices are automatically movable relative to each other so that in use the suction pump may be connected for sequential pumping periods to different said groups of one or more orifices, thereby allowing the removal of fluid from the plurality of remote wells by the suction pump.

By providing an automatic mechanical means of distributing the pumping time, costs can be kept to a minimum and the system is safer with flammable fluids than a solenoid system.

Preferably, the orifices are arranged in a regular pattern, and may be arranged linearly such that the connecting means moves linearly to connect to the different groups.

Further preferably, the orifices may be ports in a surface.

Still preferably, the connecting means may be a carriage which is movable above orifices.

Further optional features of the apparatus are defined in the accompanying claims.

In accordance with a second broad aspect of the invention there is provided a system for recovering fluid from a plurality of wells, comprising apparatus as claimed in any one of claims 1 to 17, and including a plurality of hoses or pipes providing the fluid communication between the orifices and the or pipe at one end being connected to or inserted into one of the wells and being arranged with a high point between the well and the apparatus, such that in use fluid from one pumping period can rest under the influence of gravity between the high point and the apparatus, whereby the fluid is substantially prevented from running back into the well when the suction pump is not pumping through said hose or pipe.

Preferably, the high point is proximate the well.

In accordance with a third broad aspect of the invention there is provided a system for recovering fluid from a plurality of wells, comprising apparatus as claimed in any one of claims 1 to 17 and including a plurality of hoses or pipes providing the fluid communication between the orifices and the wells, each hose or pipe at one end being connected to or inserted into one of the wells, wherein the fluid is at least partly soil air and at least one of the wells is sealed at the top to allow the soil air to be drawn through surrounding soil and to be pumped through the hose or pipe.

In order that the invention may be more clearly understood, a preferred embodiment will now be described with reference to the accompanying drawings, in which FIG. 1 is a view of the apparatus of the preferred embodiment from above;

Figure 1:
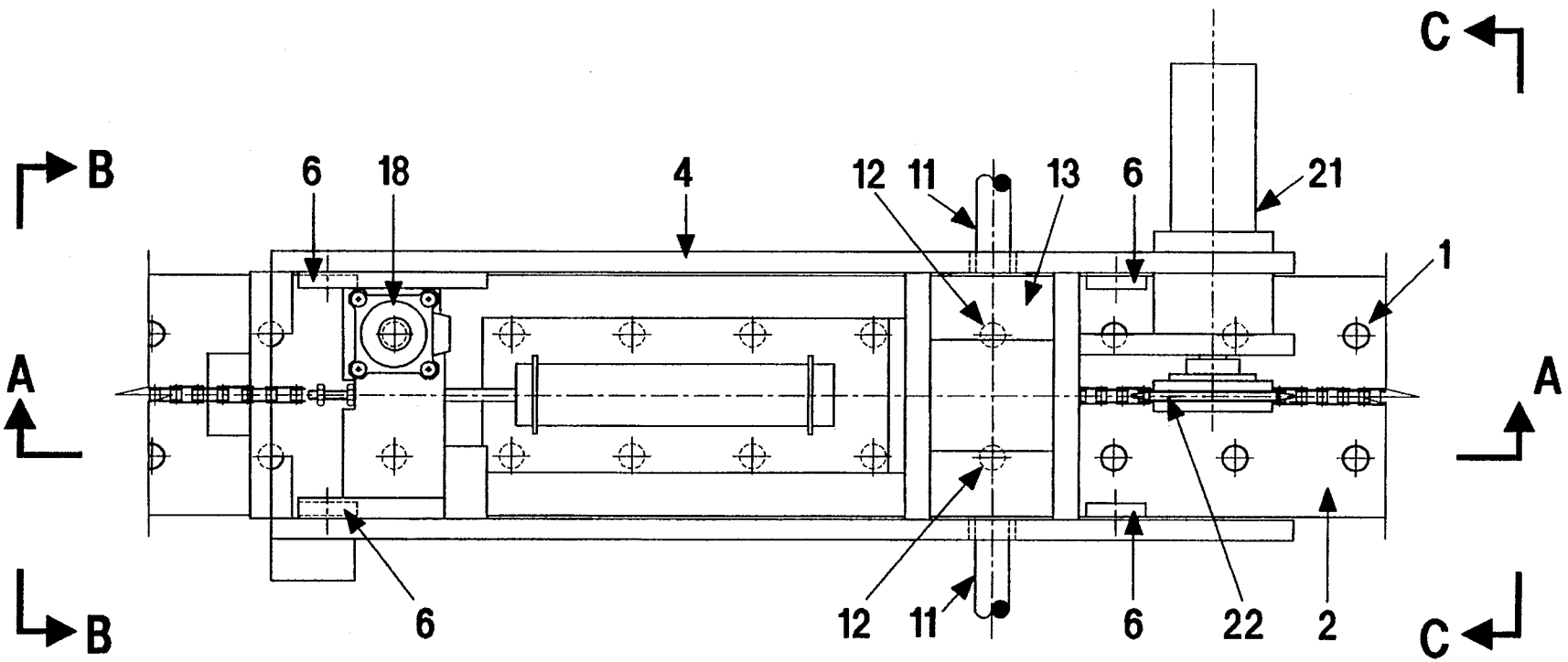
Figure 2:
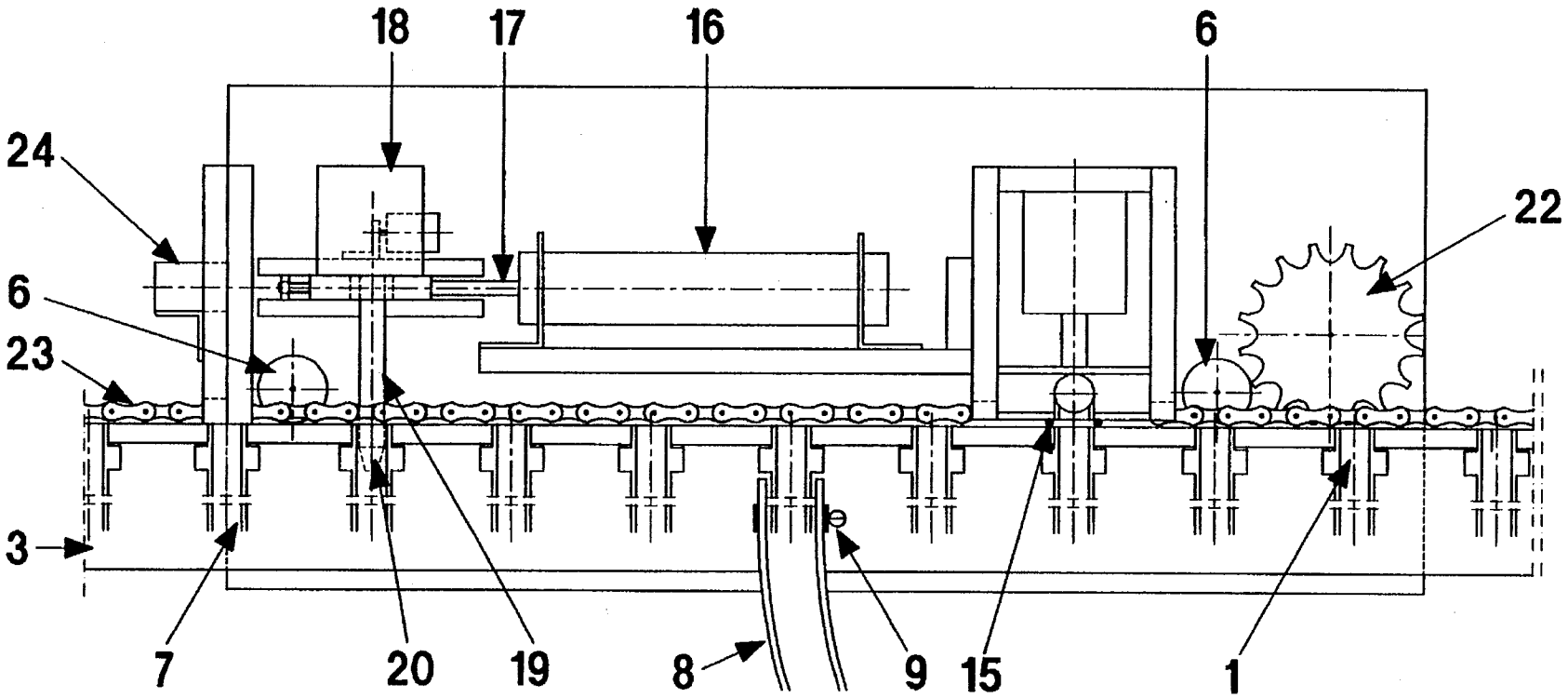
FIG. 2 is a view along the line A—A of FIG. 1.
Figure 3:
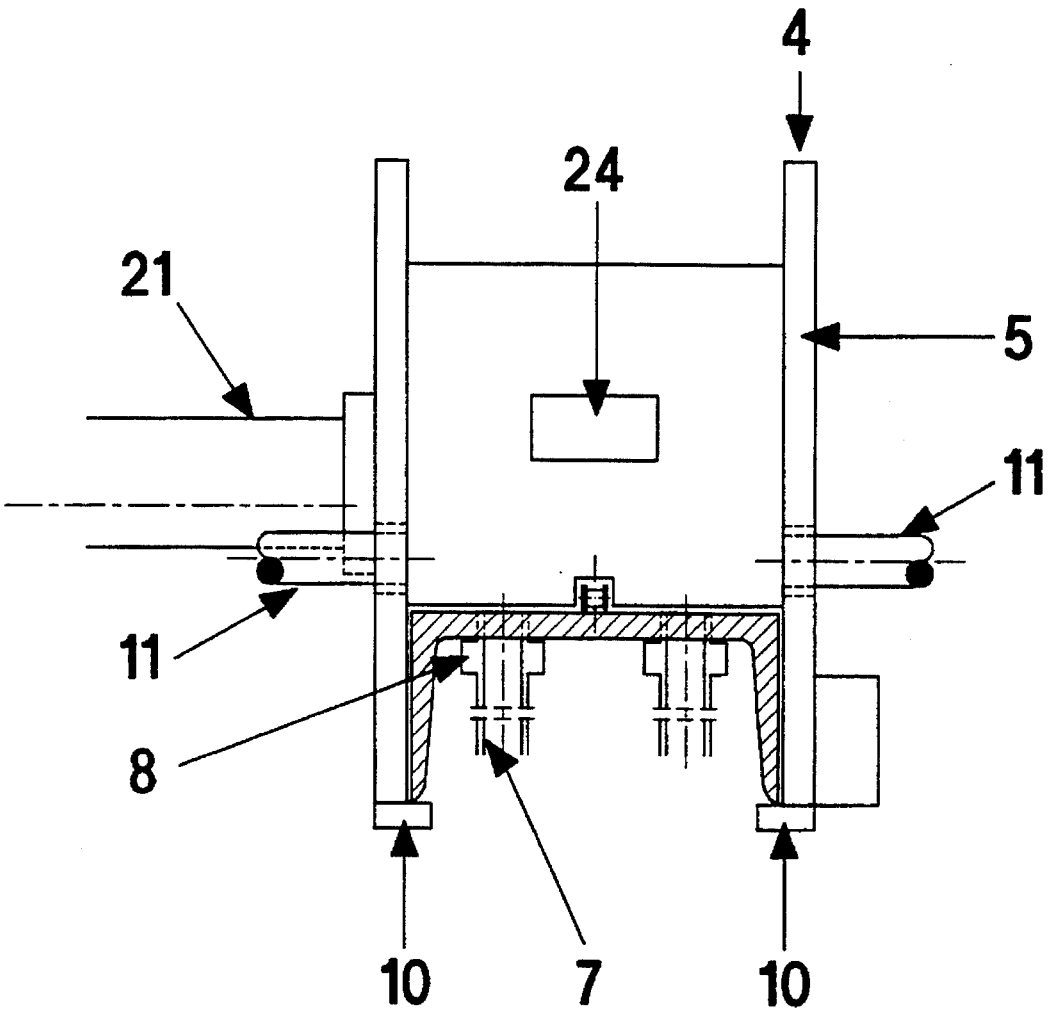
FIG. 3 is a view along the line B—B of FIG. 1.
Figure 4:
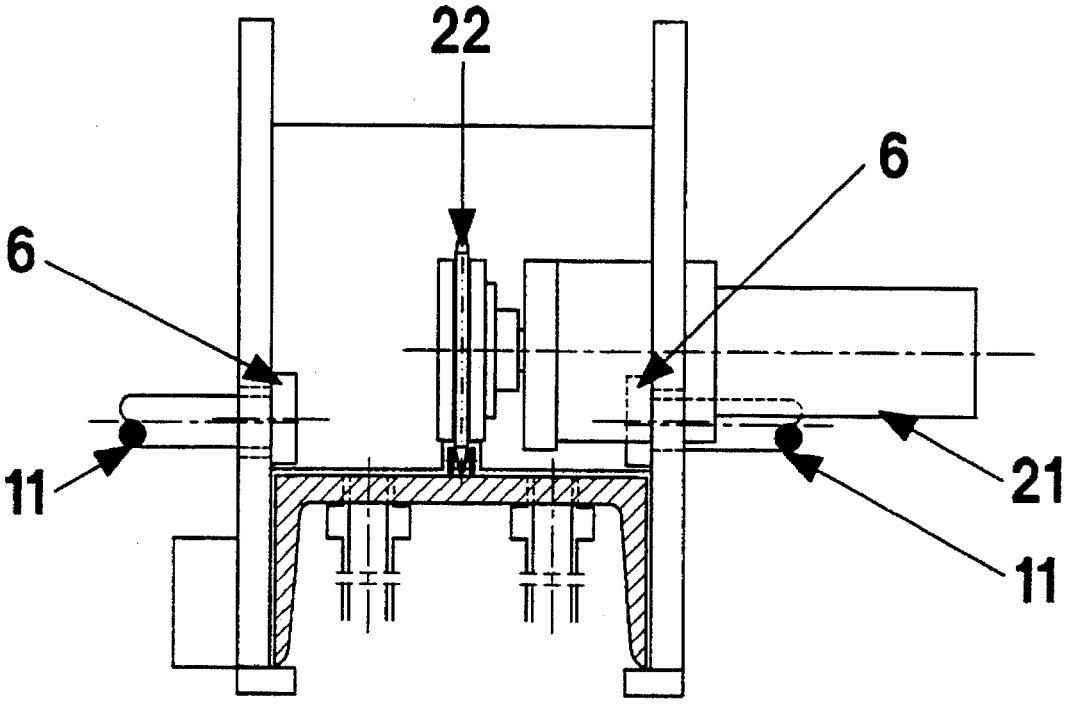
FIG. 4 is a view along the line C—C of FIG. 1.

As can be seen from the accompanying drawings, the orifices 1 are ports in a top surface 2 of a rail 3. The rail is of length sufficient to accommodate all the orifices, which are arranged in a regular linear pattern, that pattern being two parallel straight lines of ports. A connecting means comprising a carriage 4 with carriage body 5 is movable in either direction along the rail on wheels 6 which impinge on the outer edges of the surface 2.

Each port 1 has a spigot 7 extending therebeneath to provide a connection point for a hose 8 by suitable hose clips 9. The hose is made of any suitable material such as re-enforced rubber or PVC and each hose 8 is in fluid communication with a well. The carriage body 5 has walls which extend down the side of the rail 3 in order to guide the passage of the carriage along the rail. At the bottom of the side walls of the carriage body 5 are inward facing rims 10 which barely clear the bottom of the rail 3 when the carriage wheels 6 are engaging the rail, thereby limiting the vertical free-play of the carriage 4. Pipes 11 are in fluid communication with two apertures 12 in a suction plate 13 movable between raised and lowered positions by a piston 14. In the lowered position, the apertures are disposed over one of the pairs of orifices, and when a suction pump (not shown) is connected to the pipes 11 fluid can be drawn through the ports I from the wells and out through the pipes 11. An O-ring seal 15 is disposed around the apertures in the base of the suction plate 13 in order to assist in sealing with the surface 2. O-rings may of course alternatively be placed around each port 1 in the surface 2 or replaced by a different type of sealing body. The piston 14 is fixedly attached to the carriage body 5. Also fixedly attached to the carriage body is a moving means in the form of a piston 16. The arm 17 of the piston 16 is attached to an anchoring means 18 which comprises a pin 19 movable between raised and lowered positions. In the lowered position, the end 20 of the pin fits snugly inside a port and serves to provide an anchor point from which the moving means piston 16 can push the carriage laterally to move the suction plate 13 from a position above one pair of ports to an adjacent position above the next pair. A fully extended position of the piston arm 17 is calculated so that in the fully extended position the suction plate is directly above a pair of ports. The fully retracted position of the piston arm 17 is calculated to be exactly the same distance from the fully extended position as the distance between adjacent orifices along the rail.

In operation, with the pin 19 in its lowered position and the suction plate 13 in its raised position, the piston 16 pushes to its fully extended position to move the suction plate above the next orifice. The piston 14 of the suction plate is then actuated to extend to push the suction plate 13 into its lowered position in engagement with the surface 2 of the rail 3. This slightly pushes the carriage body 5 upwards so that the rims 10 engage the lower edge of the rail 3, providing a stable structure against which the piston 14 of the suction plate 13 can push to provide the vacuum seal. While fluid is being drawn through the port 1, the pin 19 is raised, thereby clearing the surface 2 and the piston 16 retracts its arm 17, thereby moving the anchoring means 18 so that the pin 19 is directly above the next port. The pin is then lowered into position, again anchoring the anchoring means. At the end of the pumping period appropriate to the particular pair of orifices, the suction plate moves into its raised position by retraction of the piston 14 and the cycle is repeated.

In this embodiment, when the carriage 4 reaches an end stop (not shown) at the end of the rail, a limit switch is actuated whereby a motor 21 drives a sprocket 22 along a chain 23 disposed along the centre of the surface of the rail, the pin 20 and suction plate 13 having been placed in their raised positions. The carriage is thereby taken back to the start of the rail where another end stop (not shown) is encountered by an end block 24. The relationship between the end block 24, the pin 19 and the end stop is calculated so that when the end block 24 engages the end stop the pin 20 is directly above the first port. Thereafter, the carriage may move along the rail port by port until it again reaches the end of the rail.

Of course the apparatus could be operated to travel port by port in either direction if desired, and further more to visit particular ports more frequently. This could be achieved by the use of toggle switches along the rail which instruct controlling means to reverse or otherwise alter the motion of the carriage 4.

In the preferred embodiment, the timing of the various actions as described above is controlled by timers, which may be part of a digital processing system, but equally the co-ordination could be controlled in addition by limit switches from the various components.

It can be seen that when the suction plate 13 is connected to a particular pair of ports, the other ports of the rail are open and therefore any liquid which is left in the hoses 8 will tend to run back towards the wells if the hoses run downhill towards the wells throughout their length. Therefore, the second aspect of the invention provides in this embodiment that the hoses 8 in their portion near the wells are raised so as to provide a gravity trap sufficient to hold fluid from one pumping period in the part of the hose between the high point and the apparatus. Clearly the suction pump must be connected to each well long enough so that a substantial amount of fluid is extracted into the hose beyond the high point, so that the weight of fluid in the hose between the high point and the well does not pull the fluid held in the hose into the well by the force of gravity. The hoses have a diameter of approximately 19 mm in this embodiment but the diameter may be varied appropriately according to the depth from which the fluid is to be drawn, the capacity of the suction pump and the characteristics of the fluid being recovered.

When the hose ends are inserted into the bottom of the walls and the wells are sunk to a position at or below an impervious layer in the soil, the system can be applied to the recovery of liquids denser than water.

Should for any reason such as safety or freezing conditions the fluid preferably be removed from the tube entirely, the pumping period can simply be extended.

Soil air (air held within the soil) may be drawn from the wells by sealing the gap between the hose and the top of the well with a plug or other suitable mechanism in accordance with the third aspect of the invention. The well can then be either devoted solely to extracting soil air, in which case the hose does not need to project down into the well, or partly in which case the hose pumps liquid when the liquid lies around the hose end and soil air otherwise. By pumping the soil air, a draught of soil air is created over the fluids in the soil, thereby drawing them towards the well. Furthermore, the soil air is refreshed, promoting biological activity in the soil.

Modifications may be made to the invention as would be apparent to a person skilled in the art of recovery system design. For example, the movement of the carriage may be accomplished by a number of alternatives, and the invention is not limited to ports in a surface any particular arrangement of orifices and the connection means may cover any number of orifices at the one time. Any juxtaposed apertures may be suitable if a matching connecting means with appropriate movements between the apertures is devised. Further, the return movement of the carriage along the rail which is shown in the preferred embodiment by a sprocket and chain may be accomplished by any other similar means, or avoided entirely by the provision of a circular or closed loop arrangement of orifices. Still further, the suction pump may be shut off for periods if the number of wells and the leaching time of the fluid in the ground allows. The hoses may be replaced by rigid pipes if desired. These and other modifications may be made without departing from the ambit of the invention, the nature of which is to be ascertained from the accompanying description, the drawings and the claims.

I claim:

1. An apparatus for recovering fluid from a plurality of wells, the apparatus including a plurality of orifices arranged side by side, each orifice in fluid communication with at least one of the wells;

connecting means, including a carriage movable above the orifice, to connect a suction pump to the orifices in groups of one or more at a time;

wherein the connecting means and the orifices are automatically movable relative to each other so that in use the suction pump may be connected for sequential pumping periods to different said groups of one or more orifices, thereby allowing the removal of fluid from the plurality of remote wells by the suction pump.

2. Apparatus as claimed in claim 1, wherein the orifices are arranged in a regular pattern.

3. Apparatus as claimed in claim 1, wherein the orifices are arranged linearly such that the connecting means moves linearly to connect to said different groups.

4. Apparatus as claimed in claim 3, wherein the linear arrangement is rectilinear.

5. A system for recovering fluid from a plurality of wells, comprising apparatus as claimed in claim 1 and including a plurality of hoses or pipes providing the fluids communication between the orifices and the wells, each hose or pipe at one end being connected to or inserted into one of the wells, wherein the fluid is at least partly soil air and at least one of the wells is sealed at the top to allow the soil air to be drawn through surrounding soil and to be pumped through the hose or pipe.

6. Apparatus as claimed in claim 1, wherein the orifices are ports in a surface.

7. Apparatus as claimed in claim 6, wherein the carriage has a suction pad movable between raised and lowered positions, in the lowered position to engage with the surface around any said group to allow the pump to draw fluid through the group and in a raised position to disengage from the surface.

8. Apparatus as claimed in claim 7, further including anchoring means laterally movable relative to the suction pad by a moving means, said anchoring means having a pin movable between raised and lowered positions, wherein in the lowered position the pin is adapted to sit partly inside a said port allowing the moving means to move the suction pad from one group to an adjacent group, and in the raised position the pin is clear of the surface allowing the moving means to shift the anchoring means laterally.

9. Apparatus as claimed in of claim 6, wherein the carriage rolls between positions on wheels which engage the surface.

10. Apparatus as claimed in claim 7, wherein rims on the base of a body of the carriage prevent the carriage lifting more than a small amount when the suction pad engages the surface whereby the suction pad may be pressed onto the surface firmly to assist in sealing the suction pad to the group of ports.

11. Apparatus as claimed in claim 7, wherein the suction pad is a plate with one or more apertures corresponding to the ports in each said group.

12. Apparatus as claimed in claim 11, wherein O-ring seals are disposed around the apertures and/or the ports to promote sealing between the apertures and the ports.

13. Apparatus as claimed in claim 6, wherein an end block is fixed at least one end of the surface such that when the carriage engages the end block, returning means caused the carriage to travel back to a starting point.

14. Apparatus as claimed in claim 13, wherein the returning means include a motor on the carriage driving a sprocket which engages a chain disposed along the surface.

15. Apparatus as claimed in claim 7, wherein in use the operation of the various components is co-ordinated by timers or digital electronics.

16. Apparatus as claimed in claim 1, wherein at least one toggle switch is provided to be actuated when the carriage passes certain points so as to monitor the position of the carriage and allow certain groups to be pumped more or less often than others.

17. Apparatus as claimed in claim 1, wherein the pumping time corresponding to each said group is variable between the groups.

18. A system for recovering fluid from a plurality of wells, comprising apparatus as claimed in claim 1, and including a plurality of hoses or pipes providing the fluid communication between the orifices and the wells, each hose or pipe at one end being connected to or inserted into one of the wells and being arranged with a high point between the well and the apparatus, such that in use fluid from one pumping period can rest under the influence of gravity between the high point and the apparatus, whereby the fluid is substantially prevented from running back into the well when the suction pump is not pumping through said hose or pipe.

19. A system as claimed in claim 18 wherein the high point is proximate the well.

* * * * *